US006741938B2

(12) United States Patent
Berndorfer

(10) Patent No.: US 6,741,938 B2
(45) Date of Patent: May 25, 2004

(54) METHOD FOR CONTINUOUSLY PREDICTING REMAINING ENGINE OIL LIFE

(75) Inventor: Axel H Berndorfer, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 226 days.

(21) Appl. No.: 10/021,473

(22) Filed: Oct. 30, 2001

(65) Prior Publication Data

US 2003/0083825 A1 May 1, 2003

(51) Int. Cl.[7] ..... G01N 31/00

(52) U.S. Cl. ..... 702/23; 702/183; 702/184; 702/187; 702/189; 701/30

(58) Field of Search ..... 702/23, 183, 184, 702/187, 189; 701/30, 29, 99; 73/53.05, 117.2, 117.3, 184; 340/457.4, 438, 439, 459, 425.5

(56) References Cited

U.S. PATENT DOCUMENTS 4,677,847 A 7/1987 Sawatari et al. ..... 73/64
5,750,887 A 5/1998 Schricker ..... 73/117.3
5,969,601 A 10/1999 Sato et al. ..... 340/450.3
6,253,601 B1 * 7/2001 Wang et al. ..... 73/117.3
6,509,749 B1 1/2003 Buelna et al. ..... 324/698

* cited by examiner

*Primary Examiner*—John Barlow
*Assistant Examiner*—Stephen J. Cherry
(74) *Attorney, Agent, or Firm*—Jimmy L. Funke

(57) ABSTRACT

A method for continuously predicting remaining engine oil life includes counting down a remaining oil life (ROL) from 100% ROL to a predetermined warning threshold at a first rate. If an oil life event occurs prior to the threshold, the countdown rate is increased until the threshold is reached. On the other hand, if the threshold is reached and the oil life event has not yet occurred, the countdown rate is decreased until the oil life event occurs. During the countdown, if fresh oil or an additive is added to the oil, the countdown rate is adjusted in a positive direction. On the other hand, if the oil becomes contaminated, the countdown rate is adjusted in a negative direction.

8 Claims, 5 Drawing Sheets

METHOD FOR CONTINUOUSLY PREDICTING REMAINING ENGINE OIL LIFE

TECHNICAL FIELD

The present invention relates generally to oil condition sensors.

BACKGROUND OF THE INVENTION

Today, many vehicles are equipped with oil life prediction algorithms or oil condition sensors that determine the life of the engine oil. Certain oil condition sensors determine the life of engine oil by quantitatively sensing an oil condition parameter, e.g., oil viscosity or oil acidity. Typically, these sensors allow a particular oil condition parameter to reach a certain threshold value, and then, indicate an oil change at least partially based upon reaching this threshold. For this group of sensors, it is easy to calculate the remaining oil life based on the fresh oil condition and the threshold value of the particular parameter, interpolate between these values, and translate the result into miles.

Other sensors do not quantitatively sense oil condition parameters, but rather look for a repeatable pattern of an oil condition parameter. When shown against elapsed operation time or miles driven, the oil condition parameter displays an oil condition parameter curve or trend. Such a trend would contain an event, e.g., a maximum or a minimum, which is known to correlate to a certain oil condition. The problem is to predict the remaining oil life in the time before this event happens in the trend.

One exemplary oil condition sensor trend, i.e., the output of the sensor plotted versus mileage or time, can be represented graphically by a parabolic curve opening downward. Specifically, over the life of the oil, its, e.g., conductivity, will increase to an apex and then decrease—closely resembling a parabolic curve. A control module connected to the sensor can determine when the oil should be changed based on the output of the sensor. For example, after a series of decreasing output values, the control module can send a signal to an output device to indicate to the driver that the oil should be changed soon. If the output values of the sensor continue to decrease, indicating further degradation of the oil condition, the control module can send another signal to an output device to indicate that the oil should be changed immediately.

Depending on the type of oil used, e.g., mineral, synthetic, etc., and the engine operating parameters, e.g., temperature, engine operating speed (rpm), etc., the sensors may indicate that the oil should be changed very early, e.g., four thousand miles driven, or very late, e.g., twenty thousand miles driven. Based on the oil condition parameter sensed, the control module connected to the sensor simply provides warnings, e.g., "Change Oil Soon" or "Change Oil Now." However, in the case of an event related oil life sensor as described above, the control module is unable to provide a relatively accurate indication of the remaining oil life (ROL) before the warnings or therebetween. As such, a driver may not know whether the ROL of the engine oil is about to approach a critical level. Thus, if the driver is about to embark on a long trip in the vehicle, he or she may be unaware that the oil should be changed because the ROL is quite low, but not low enough to trigger, e.g., a "Change Oil Soon" warning. Moreover, without an indication of the ROL, the driver may choose to change the oil earlier than necessary based simply on the miles driven when, in fact, the engine oil may have a relatively high ROL.

The present invention has recognized these prior art drawbacks, and has provided the below-disclosed solutions to one or more of the prior art deficiencies.

SUMMARY OF THE INVENTION

A method for predicting remaining life of engine oil includes counting down a remaining oil life value toward a predetermined early warning threshold at a first countdown rate. Based on a first oil life event, the countdown rate is increased or decreased. Moreover, a continuous indication of the remaining oil life is provided using the countdown rate.

In a preferred embodiment, the method further includes counting down the remaining oil life value from the early warning threshold to a predetermined final warning threshold at a second countdown rate. Based on a second oil life event, the second countdown rate is increased or decreased. Preferably, any countdown rate or the actual ROL value can be adjusted in a positive or negative direction in response to the addition of fresh oil to the system or to contamination of the oil.

In another aspect of the present invention, a system for predicting remaining life of engine oil includes an engine and an oil pan that provides oil to the engine. An oil condition sensor communicates with oil in the oil pan. Moreover, a control module is electrically connected to the oil condition sensor. In this aspect, the control module includes a program for predicting remaining oil life of the engine oil based on signals from the sensor. Also, a display for presenting an indication of the remaining oil life is coupled to the control module.

In yet another aspect of the present invention a method for predicting remaining life of engine oil includes counting down a remaining oil life value toward a predetermined threshold at a countdown rate. In this aspect, the countdown rate is based on an oil life event. Moreover, a continuous indication of the remaining oil life is provided.

The present invention will now be described, by way of example, with reference to the accompanying drawings, in which:

DESCRIPTION OF AN EMBODIMENT OF THE INVENTION

Figure 1:
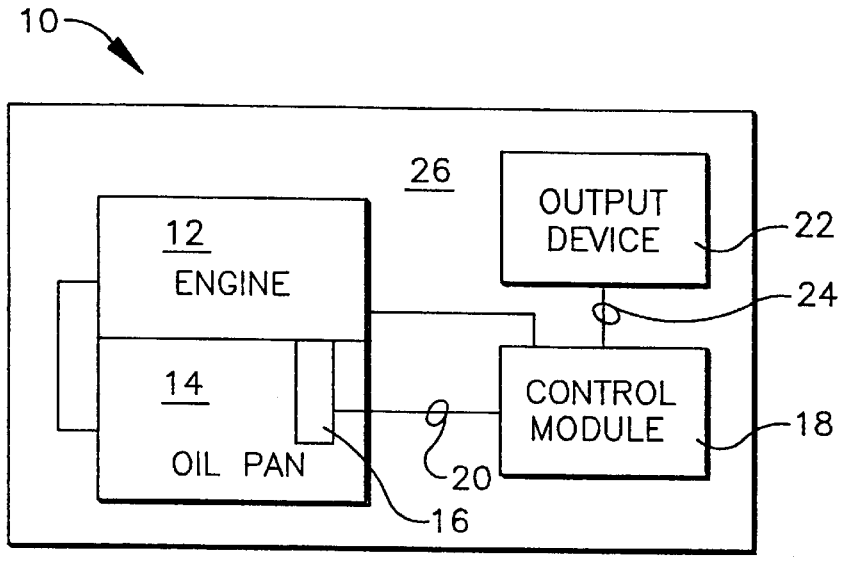
FIG. 1 is a block diagram of an engine lubrication system.

Referring initially to FIG. 1, an engine lubrication system is shown and generally designated 10. FIG. 1 shows that the lubrication system 10 includes an engine 12 in fluid communication with an oil pan 14 that provides lubricating oil to the internal engine components, e.g., the crankshaft, camshafts, rocker arms, pushrods, pistons, etc.

As shown in FIG. 1, an oil condition sensor 16 is installed in the oil pan 14 so that it communicates with oil therein. The sensor 16 can be an oil condition sensor made by Delphi, with the novel logic set forth herein embodied in the sensor itself or in a microprocessor housed apart from the sensor.

FIG. 1 further shows a control module 18 electrically connected to the oil condition sensor 16 by electric line 20. Also, an output device 22 is electrically connected to the control module 18 by electric line 24. As shown, the entire system 10 is disposed within a vehicle 26. However, it is to be appreciated that the system 10 can be part of a stationary engine, e.g., a stationary power generator.

It is to be understood that the control module 18 can be, e.g., an engine control module (ECM) or a body control module (BCM). Moreover, it is to be understood that the output device 22 can be an audible warning device, e.g., a buzzer or audible alarm. The output device 22 can also be a visual warning device, e.g., a warning lamp or other visual display. Or, the output device 22 can be a visual indicator of the remaining oil life (ROL) of the engine oil, e.g., a gauge or similar device. Moreover, the output device 22 can be a wireless communication device that outputs a signal to a computer or similar device used by a manager who oversees the maintenance of a fleet of vehicles.

While the preferred implementation of the control module 18 is an onboard chip such as a digital signal processor, it is to be understood that the logic disclosed below can be executed by other digital processors, such as by a personal computer. Or, the control module 18 may be any computer, including a Unix computer, or OS/2 server, or Windows NT server, or a laptop computer. In the case of a "smart" oil condition sensor, the logic can be executed by a processor within the sensor.

The control module 18 includes a series of computer-executable instructions, as described below, which will allow the control module 18 to predict the ROL of the engine oil within the lubrication system based on actual events occurring during the life of the engine oil, e.g., a "Change Oil Soon" (COS) warning and a "Change Oil Now" (CON) warning. These instructions may reside, for example, in RAM of the control module 18.

Alternatively, the instructions may be contained on a data storage device with a computer readable medium, such as a computer diskette. Or, the instructions may be stored on a magnetic tape, conventional hard disk drive, electronic read-only memory, optical storage device, or other appropriate data storage device. In an illustrative embodiment of the invention, the computer-executable instructions may be lines of compiled C++ compatible code.

The flow charts herein illustrate the structure of the logic of the present invention as embodied in computer program software. Those skilled in the art will appreciate that the flow charts illustrate the structures of computer program code elements including logic circuits on an integrated circuit, that function according to this invention. Manifestly, the invention is practiced in its essential embodiment by a machine component that renders the program elements in a form that instructs a digital processing apparatus (that is, a computer) to perform a sequence of function steps corresponding to those shown.

Figure 2:
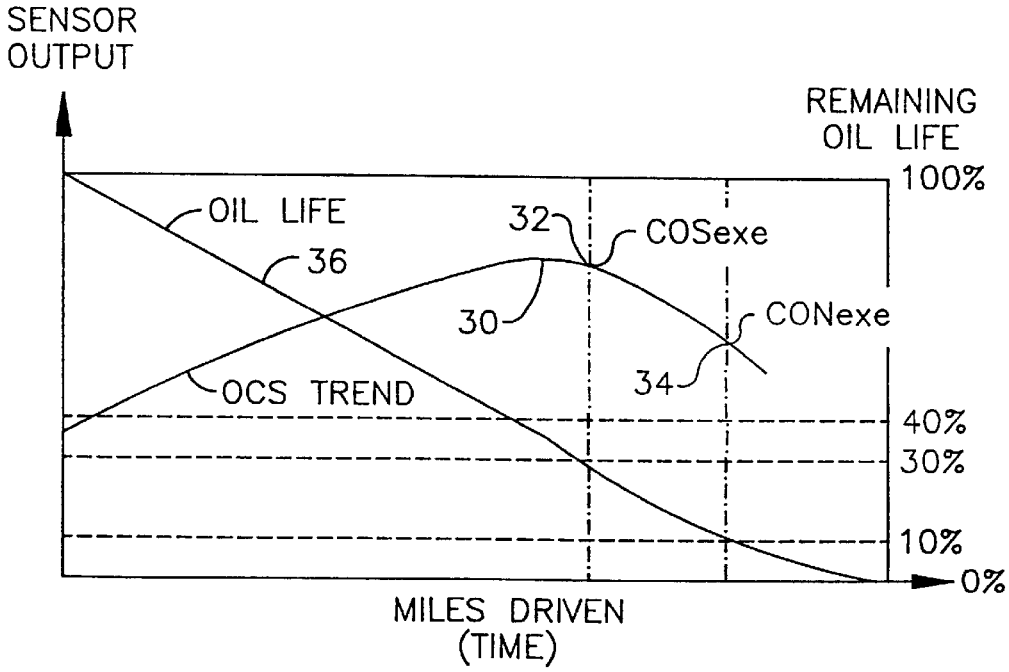
FIG. 2 is a graph showing an average oil condition sensor trend and an ideal remaining oil life curve.
Figure 3:
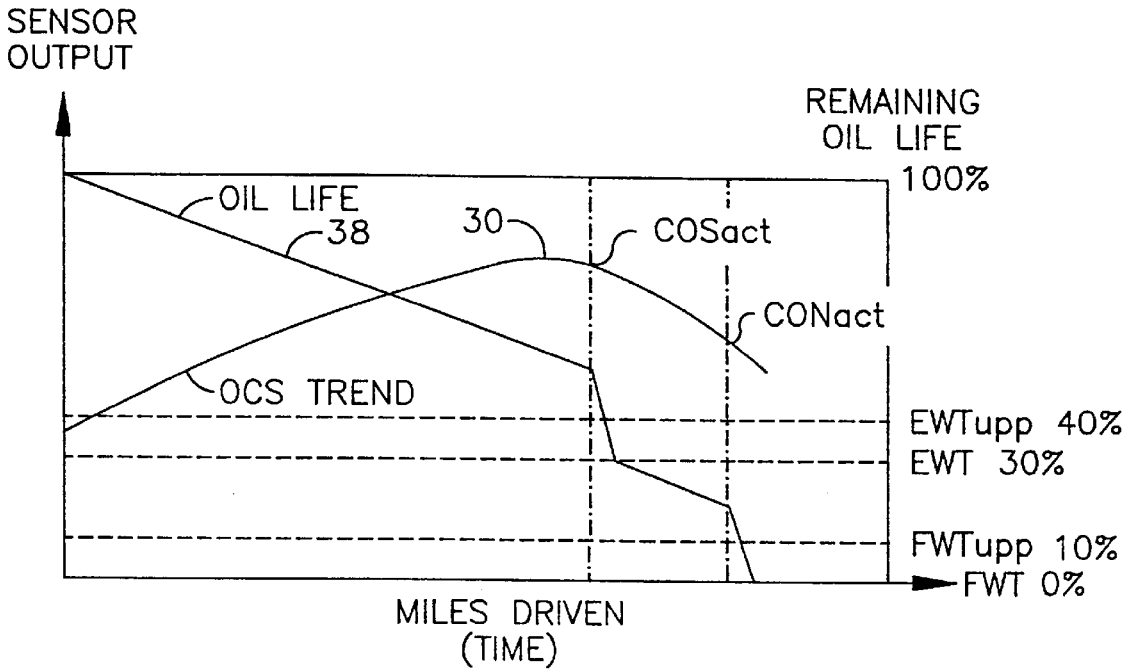
FIG. 3 is a graph showing an oil condition sensor trend and a first adjusted remaining oil life curve.
Figure 4:
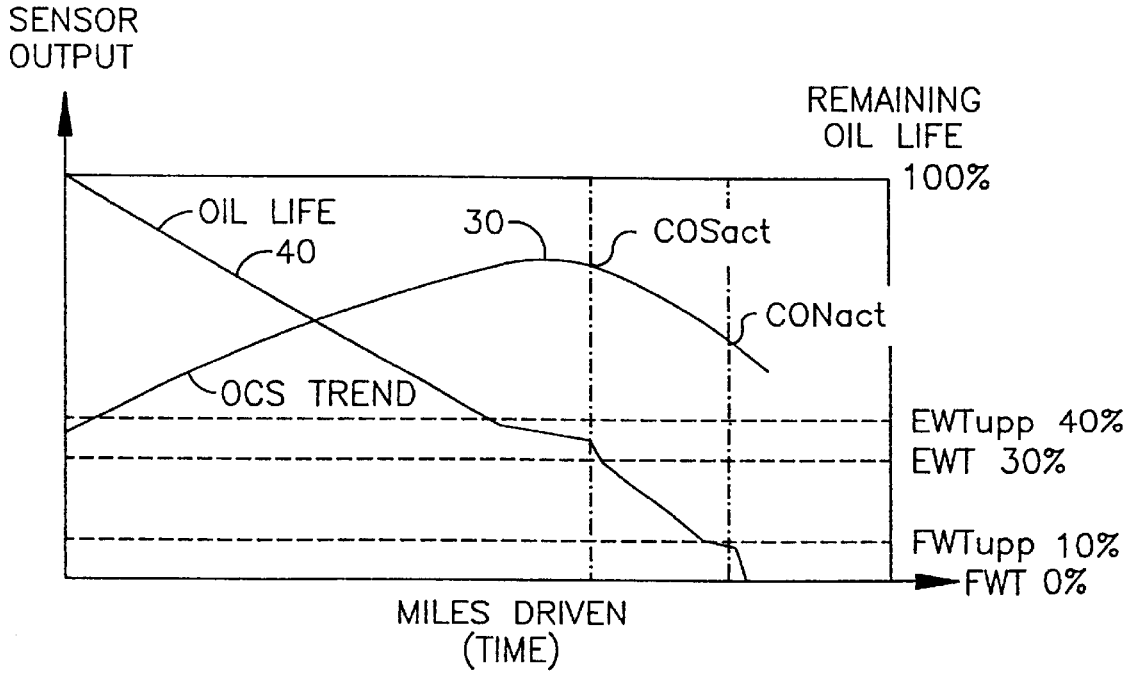
FIG. 4 is a graph showing an oil condition sensor trend and a second adjusted remaining oil life curve.

Referring now to FIGS. 2–4, a parabolic curve 30 that represents an exemplary oil condition sensor (OCS) trend, i.e., the sensor output versus time, is shown. FIG. 2 also shows an exemplary "Change Oil Soon" ($COS_{exe}$) warning 32 that typically occurs after the OCS trend peaks. After the $COS_{exe}$ warning occurs, a second exemplary warning, a "Change Oil Now" ($CON_{exe}$) warning 34, occurs when the negative slope increases. As stated above, event related oil life sensors simply provide the driver of a vehicle with these two warnings 32, 34. Regardless of the length of the oil life, on average the $COS_{exe}$ warning occurs, e.g., at approximately 30% ROL and the $CON_{exe}$ warning typically occurs at approximately 0% ROL.

FIG. 2 shows an ideal remaining oil life curve 36. This ideal ROL curve 36 is simply, e.g., a linear curve from 100% ROL to 30% ROL and from 30% ROL to 0% ROL, but it is to be understood that ROL curve could be a non-linear curve. FIGS. 3 and 4 show a first adjusted ROL curve 38 and a second adjusted ROL curve 40, respectively. The adjusted ROL curves 38, 40 represent predicted remaining oil life values that are based on the actual timing of the oil life events, e.g., $COS_{act}$ and $CON_{act}$, relative to $COS_{exe}$ 32 and $CON_{exe}$ 34, respectively. Both of these curves are described in detail below in conjunction with the description of the operation logic.

Figure 5:
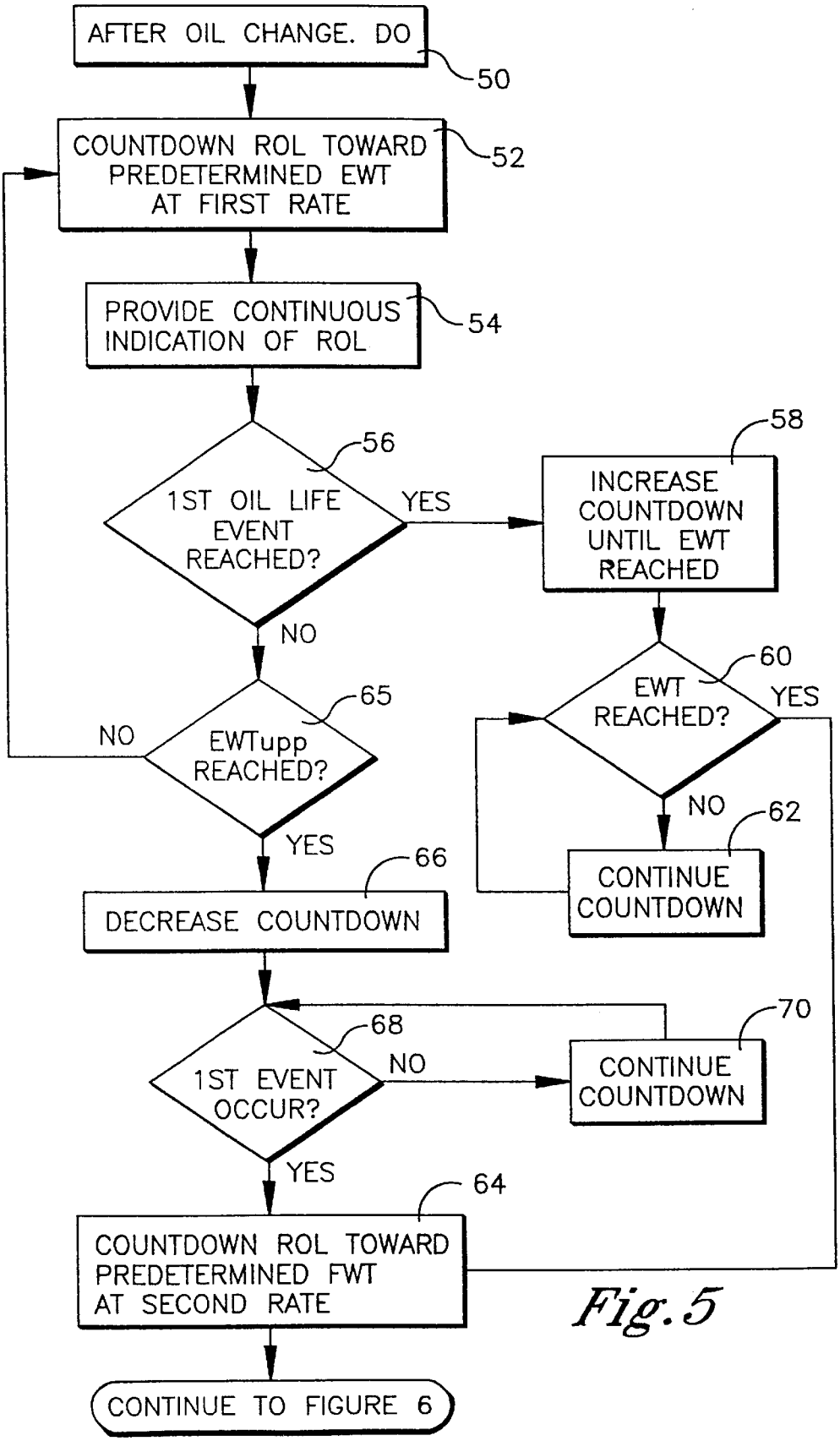
FIG. 5 is a flow chart of a portion of the operation logic of the present invention.

Referring now to FIG. 5, the operation logic of the present invention is shown. Commencing at block 50, a do loop is entered wherein after the engine oil is changed, the succeeding steps are performed. At block 52, a countdown of the remaining oil life (ROL) begins. The countdown begins at 100% ROL and countdowns at a preferably constant rate toward a predetermined early warning threshold (EWT), e.g., 30% ROL. Moving to block 54, a continuous indication of the ROL is provided, e.g., by providing a signal from the control module 18 to the output device 22. In a preferred embodiment, the countdown begins at 100% ROL and decreases incrementally, e.g., in 1% increments, until the countdown reaches 0% or an intervening event occurs, e.g., fresh oil is added to the system 10, an oil additive is added to the system 10, the oil is contaminated, or the oil within the system 10 is changed. In these cases, the ROL is adjusted up or down accordingly.

At decision diamond 56, it is determined whether a first oil life event, e.g., the $COS_{act}$, is reached. If so, at block 58, the ROL countdown rate is increased until the EWT is reached. Preferably, the countdown is increased, e.g., so that the slope of the graph of the ROL increases dramatically as it approaches the EWT, as shown in FIG. 3. Proceeding to decision diamond 60, it is determined whether the EWT is reached. If not, the logic moves to block 62 where the countdown continues, and the logic returns to decision diamond 60. On the other hand, if at decision diamond 60, the EWT is reached, the logic proceeds to block 64 where the ROL countdown proceeds at a constant linear rate toward a predetermined final warning threshold (FWT), e.g., 0% ROL.

Returning to decision diamond 56, if the first oil life event is not reached, the logic moves to decision diamond 65 where it is determined whether a predetermined early warning threshold ($EWT_{upp}$), e.g., 40% ROL, is reached. If not, the logic returns to block 52 wherein the ROL countdown toward the EWT continues at the first rate. If the $EWT_{upp}$ is reached, the logic continues to block 66 where the ROL countdown is decreased, e.g., so that the slope of the graph of the second adjusted ROL shown in FIG. 4 decreases. Although the graph shown in FIG. 4 is linear, it is to be understood that the graph can approach a horizontal axis through the EWT asymptotically. The logic then moves to decision diamond 68 where it is determined whether the $COS_{act}$ is triggered. If not, the logic continues to block 70 where the countdown is continued. If the test at decision diamond 68 is positive, however, the logic proceeds to block 64 where the ROL is counted down toward a predetermined final warning threshold (FWT) at a preferably constant rate, e.g., linearly as shown in FIG. 3.

Figure 6:
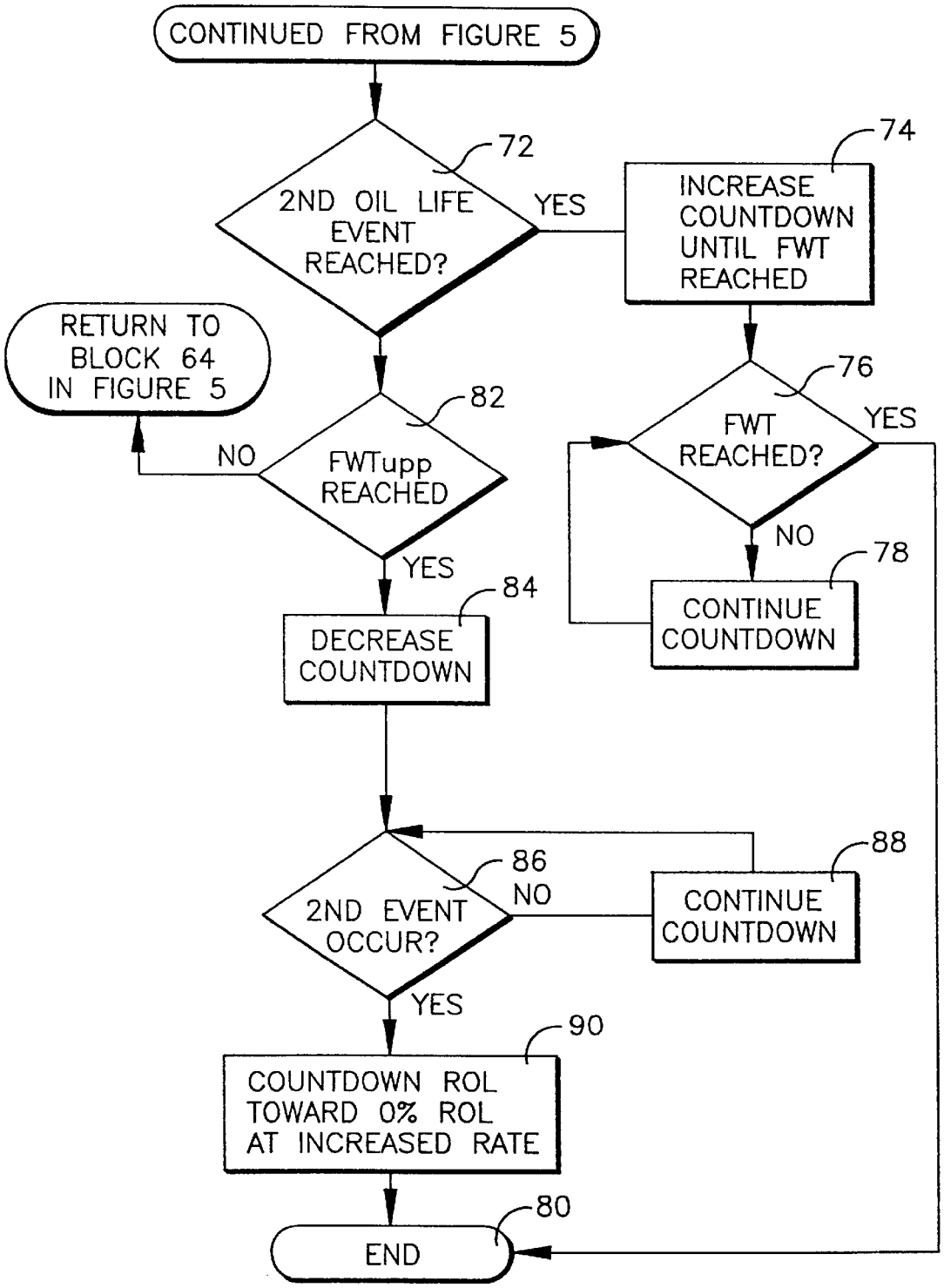
FIG. 6 is a flow chart of the remaining portion of the operation logic of the present invention.

Referring now to FIG. 6, the logic enters decision diamond 72 where it is determined whether a second oil life event, e.g., a $CON_{act}$, is reached. If so, at block 74, the countdown is increased as above until the FWT is reached. Proceeding to decision diamond 76, it is determined whether the FWT is reached. If not, the logic moves to block 78 where the countdown is continued, and the logic returns to decision diamond 76. If at decision diamond 76 it is determined that the FWT is reached the logic ends at state 80.

Returning to decision diamond 72, if the $CON_{act}$ is not reached, the logic continues to decision diamond 82 where it is determined whether a predetermined upper final warning threshold ($FWT_{upp}$), e.g., 10% ROL is reached. If not, the logic returns to block 64 in FIG. 5 and the countdown toward the FWT is continued at the second rate. If so, the logic continues to block 84 where the ROL countdown is decreased, e.g., so that the slope of the graph of the ROL shown in FIG. 4 decreases dramatically. The graph shown in FIG. 4 is linear, but it is to be understood that the graph can approach a horizontal axis through FWT asymptotically. Thereafter, the logic moves to decision diamond 86 where it is determined whether the $CON_{act}$ is triggered. If not, the logic continues to block 88 where the decelerated countdown is continued. In contrast, when the actual CON is triggered, the logic proceeds to block 90 where the ROL is counted down toward 0% ROL at an increased rate. The operation logic then ends at state 80.

It may now be appreciated that the ROL indication preferably is based not on engine operating parameters but on actual oil life events as determined by the oil sensor 16.

Figure 7:
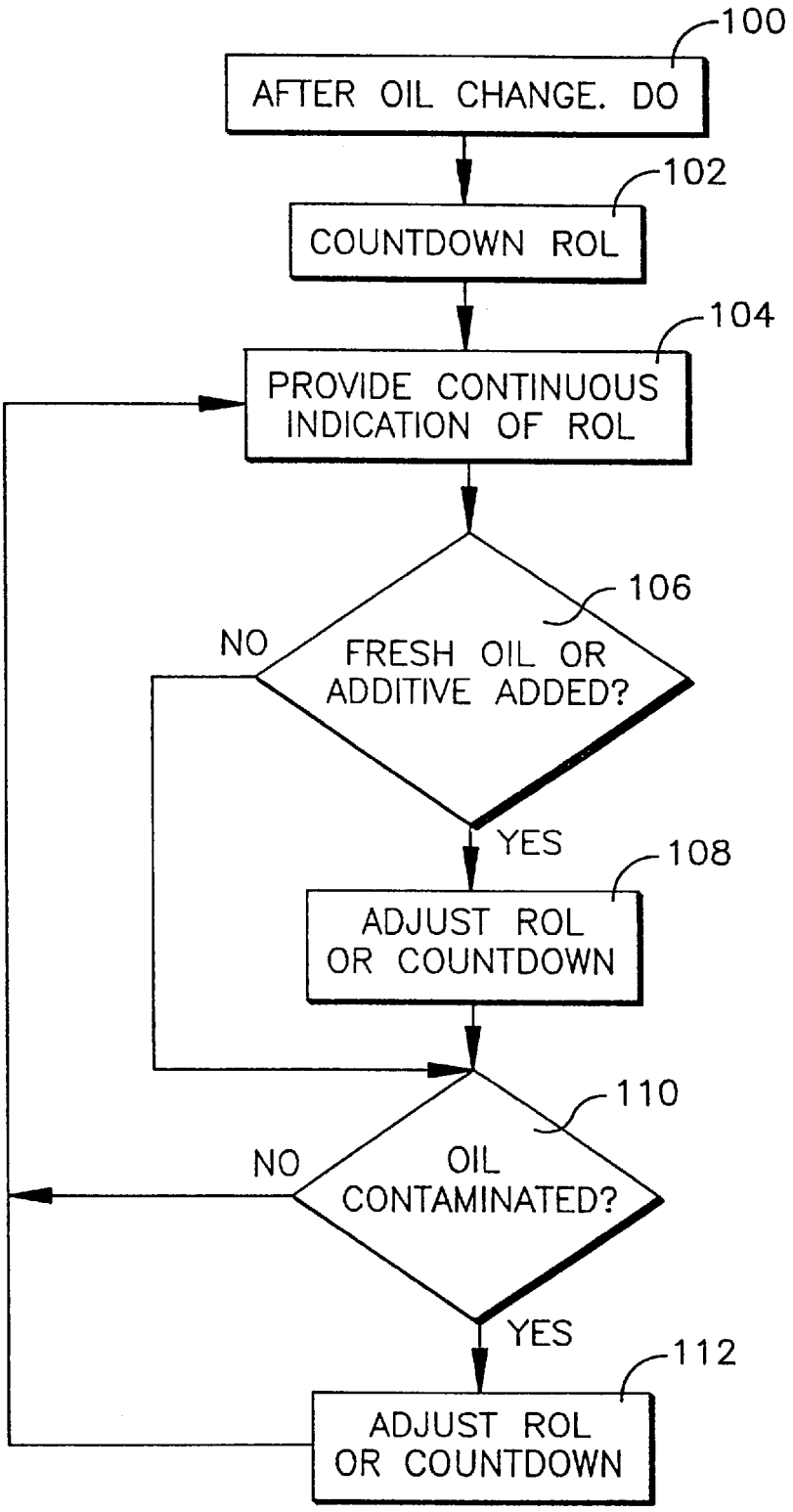
FIG. 7 is a flow chart of the remaining oil life adjustment logic.

Referring now to FIG. 7, the adjustment logic of the present invention is shown. Commencing at block 100 a do loop is entered wherein after the oil is changed, the following steps are performed. Moving to block 102, the remaining oil life is counted down as described above. Thereafter, at block 104, a continuous indication of the ROL is provided. Continuing to decision diamond 106, it is determined whether fresh oil or an oil additive is added to the oil within the system 10. If so, the logic proceeds to block 108 wherein the ROL or the countdown is adjusted to account for the prolonged ROL due to the fresh oil or oil additive. For example, if at 50% ROL fresh oil or an additive is added to the engine oil, the ROL can be adjusted upward to, e.g., 60% ROL.

If, at decision diamond 106, it is determined that fresh oil or an additive has not been added to the system, the logic proceeds to decision diamond 110 wherein it is determined whether or not the oil has been contaminated, e.g., by engine coolant. If so, the logic continues to block 112 where the ROL or the countdown is adjusted to account for the contamination. For example, if at 50% ROL the oil is contaminated, the ROL can be adjusted downward to, e.g., 5% ROL. Thereafter, the logic returns to block 104 wherein a continuous indication of the ROL is provided. Returning to decision diamond 110, if the oil has not been contaminated, the logic again returns to block 104.

Although the above logic shows two target points, EWT and FWT, it is to be understood that a single target point can be used, e.g., FWT. Alternatively, more than two target points can be used. It is to be understood that regardless of the amount of target points, the countdown logic will follow the same pattern as described above, i.e., the countdown will increase or decrease based on the occurrence of the oil life even with respect to the target point. Specifically, if a single target point is used, the logic will follow the steps described in FIG. 5 and then, instead of counting toward another target point, FWT, the logic counts down the ROL toward 0%.

With the configuration of structure described above, it is to be appreciated that the method for predicting remaining engine oil life provides a means for indicating to the driver of a vehicle the remaining life of the oil within the engine lubrication system 10. The remaining oil life is predicted based on actual oil life events and the countdown representing the remaining oil life is accelerated or decelerated based when these oil life events occur relative to predetermined warning thresholds. Moreover, the remaining oil life countdown is adjusted up or down depending on whether fresh oil is added to the system 10, oil additives are added to the system 10, or if the oil within the system 10 becomes contaminated.

While the particular METHOD FOR CONTINUOUSLY PREDICTING REMAINING ENGINE OIL LIFE as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A method for predicting remaining life of engine oil, comprising the acts of:

counting down a remaining oil life value toward a predetermined early warning threshold at a first countdown rate;

at least partially based on a predetermined exemplary first oil life event, increasing the first countdown rate, or, alternatively, at least partially based on an upper early warning threshold, decreasing the first countdown rate;

using the first countdown rate, providing a continuous indication of the remaining oil life."

2. The method of claim 1, further comprising the act of:

at least partially based on an actual first oil life event, counting down the remaining oil life toward a predetermined final warning threshold at a second countdown rate;

at least partially based on a predetermined exemplary second oil life event, increasing the second countdown rate;

at least partially based on an upper final warning threshold, decreasing the second countdown rate; and at least partially based on an actual second oil life event, increasing the second countdown rate.

3. The method of claim 2, further comprising the act of: adjusting the first or second countdown rate in a positive direction.

4. The method of claim 2, further comprising the act of: adjusting the first or second countdown rate in a negative direction.

5. A system for predicting remaining life of engine oil, including:

at least one engine;

at least one oil pan providing oil to the engine;

at least one oil condition sensor communicating with the oil;

at least one control module electrically connected to the oil condition sensor, the control module including a program for predicting remaining oil life of the engine oil based on signals from the sensor; and at least one display coupled to the control module for presenting an indication of the remaining oil life, wherein the program comprises:

logic means for counting down a remaining oil life value toward a predetermined early warning threshold at a first countdown rate;

logic means for increasing the first countdown rate at least partially based on a predetermined exemplary first oil life event;

logic means for decreasing the first countdown rate, at least partially based on an upper early warning threshold.

6. The system of claim 5, wherein the program further comprises:

logic means for counting down the remaining oil life toward a predetermined final warning threshold at a second countdown rate at least partially based on an actual first oil life event;

logic means for increasing the second countdown rate at least partially based on a predetermined exemplary second oil life event;

logic means for decreasing the second countdown rate at least partially based on an upper final warning threshold; and logic means for increasing the second countdown rate at least partially based on an actual second oil life event.

7. The system of claim 6, wherein the program further comprises:

logic means for adjusting the first or second countdown rate in a positive direction.

8. The system of claim 6, wherein the program further comprises:

logic means for adjusting the first or second countdown rate in a negative direction.

* * * * *